United States Patent [19]

Anthonioz

[11] 4,083,157

[45] Apr. 11, 1978

[54] FALSE CEILING OR WALL

[75] Inventor: Camille Anthonioz, Thonon Les Bains, France

[73] Assignee: Societe Normalu, Kembs, France

[21] Appl. No.: 684,636

[22] Filed: May 10, 1976

[30] Foreign Application Priority Data

May 7, 1975 France ..... 75 14275

[51] Int. Cl.[2] ..... E04B 1/00

[52] U.S. Cl. ..... 52/222; 52/273

[58] Field of Search ..... 52/222, 63, 273; 160/395

[56] References Cited

U.S. PATENT DOCUMENTS

| | | | |
|---|---|---|---|
| 3,205,628 | 9/1965 | Frisk | 52/222 |
| 3,323,819 | 6/1967 | Barker | 160/395 X |
| 3,719,013 | 3/1973 | Blick | 52/222 |

FOREIGN PATENT DOCUMENTS

| | | | |
|---|---|---|---|
| 323,189 | 4/1970 | Sweden | 52/222 |

*Primary Examiner*—Ernest R. Purser
*Assistant Examiner*—Carl D. Friedman
*Attorney, Agent, or Firm*—J. Harold Nissen

[57] ABSTRACT

A false ceiling or wall comprising a frame which can be fixed to the edges of a ceiling or wall and is adapted to hold a sheet having a rigid edge. The frame includes a rail having an abutment thereon and shoulder forming a free space therebetween to receive a rigid edge of the sheet. The rigid edge of the sheet has a hook shape which engages the shoulder when in place, and the shoulder extends in a direction to that in which the sheet material exerts tension.

10 Claims, 11 Drawing Figures

FALSE CEILING OR WALL

This invention relates to false ceilings and false walls.

False ceilings are already known comprising, on the one hand, a horizontal frame fixed to the top of the walls of a room, the frame being in the form of an external rail consisting of sections, and, on the other hand, a plastics sheet or cloth held in a taut position in the frame by the engagement therein of a rigid edge of the sheet.

A known false ceiling of this type presents a certain number of disadvantages. Firstly, the edge of the cloth, in the form of a sort of "harpoon", must possess a very precise toughness which lies between narrow limits. In this respect, if this edge is not fairly rigid, it can disengage by yielding when it is rotated to wedge it into the frame. In contrast, if it is too rigid, its extension, necessary for its wedging, is prevented. Moreover, as the edge is held wedged in a groove, the positioning of this edge is difficult. In this respect, if the edge has not been engaged in the correct place, it has to be disengaged over a certain length to be able to remedy this mistake in positioning, due to the fact that the edge is not able to slide in the groove.

Finally, it is difficult to disengage the edge because of the fact that it is wedged in. With poorly trained personnel, a pointed tool has to be used to raise the lower lip of the edge.

According to the invention, there is provided a false ceiling or wall comprising a frame for fixing to the edges of the ceiling or wall, and a sheet having a rigid edge adapted to engage in the frame, wherein the frame comprises a rail having a shoulder extending in the opposite direction to that in which the sheet will exert tension, when in place, and the rigid edge of the sheet has a hook-shape, when seen in section, which engages the shoulder.

The invention offers the advantage that the false ceiling or wall may be positioned very simply by a non-specialised person. Great dimensional precision is not required for the two main components, i.e. the edge of harpoon shape and the rail, as these two elements are preferably constructed of plastics material.

In this manner the additional costs of the known false ceiling system arising from the control of tolerances and rejects are avoided.

The simplicity of installation of the false ceiling considerably reduces risks of tearing during its assembly. The edge of harpoon shape no longer needs to possess the hardness required by the known false ceiling system in which the harpoon is locked in a housing. This now has substantially the same elasticity as the cloth.

In positioning, the edge slides easily on its shoulder, so preventing any possibility of false placing.

To disengage the cloth from the shoulder, a push with the hand is sufficient without having to use any pointed object such as an awl or pointed tool. The false ceiling or wall according to the invention thus offers a fixing device which is reliable, rapid and economical, and which does not require the services of a qualified specialist. The sheet or cloth may be very easily removed, for example to repair electric cables or water pipes concealed thereby.

In a preferable feature of the invention, the rail comprises an abutment behind the shoulder, against which the end of the hook forming the edge of the sheet strikes and is halted should this hook open under the effect of strong tension in the cloth.

It has been found in fact that in certain cases where the sheet is very strongly stretched in use, there is a risk that the hook forming the edge of the sheet will open, so that the sheet is no longer retained in a satisfactory manner by the shoulder.

The inclusion of this additional characteristic ensures perfect and reliable locking of the hook on its shoulder, by preventing any risk of escape.

The invention will now be further described, by way of example, with reference to the accompanying drawings, in which.

Figure 1:
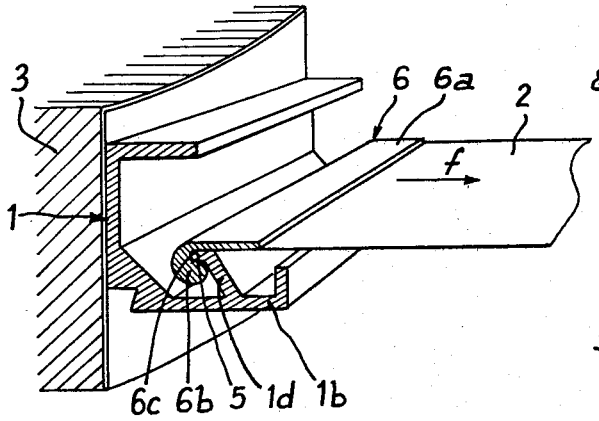
FIG. 1 is a vertical sectional perspective view of part of a false ceiling according to the invention, the cloth being shown engaged in the rail forming the frame.
Figure 3:
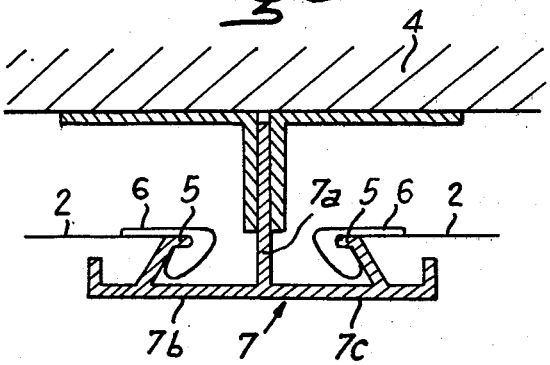

As shown in FIG. 1, the false ceiling according to the invention comprises a horizontal frame consisting of an external rail 1, and a cloth 2 of polyvinyl chloride or similar material retained taut horizontally in the frame. The rail 1 is fixed to the top of the walls 3 of a room. However, this rail could equally be fixed to the ceiling 4, as shown in FIG. 3. The rail 1 comprises a vertical flange 1*a* by which it is fixed to the wall 3, and a lower horizonta flange 1*b* extending towards the interior of the member and terminating in a vertical rim 1*c* turned upwards.

A rib 1*d* extends from the lower horizontal flange 1*b* upwards in the direction of the vertical flange 1*a*. The rib 1*d* terminates in a horizontal shoulder 5 extending in the direction of the flange 1*a*.

The cloth 2 comprises on all its borders an edge 6 of resilient plastics material in the form of a hook opening towards the middle of the cloth. The edge 6, which forms a sort of harpoon, comprises a thin part 6*a* by which it is fixed to the cloth 2, for example by high frequency welding, this thin part being prolonged outwards and under the cloth 2 by a thicker part 6*b* forming a bead. This bead is of rounded or angular shape. The thin part 6*a* and bead 6*b* form therebetween a groove 6*c* which opens towards the centre of the cloth 2. This groove is designed to receive the horizontal shoulder 5 when the cloth 2 is stretched into the frame, as shown in FIG. 1. This figure shows that the shoulder 5 extends in the reverse direction to that of the traction exerted by the taut cloth 2, and indicated diagrammatically by the arrow *f*. The inclined rib 1*d* acts in the manner of a strut for the shoulder 5, to bear the force due to the tension in the cloth 2. The rail forming the frame into which the cloth 2 is stretched may be constructed in various shapes.

In FIG. 3, the rail 7 has the general shape of an inverted T and comprises a vertical flange 7*a* fixed to the ceiling 4 by any appropriate means, and two lower horizontal opposing flanges 7*b* and 7*c*. Each of these horizontal flanges comprises a horizontal shoulder 5 directed towards the central vertical web 7*a*.

The double rail 7 is thus used as a cross member when the dimensions of the ceiling require the positioning of several elements. In this case, two cloths 2 lying in the same horizontal plane may be hooked by their edge 6 to the two shoulders 5.

Figure 4:
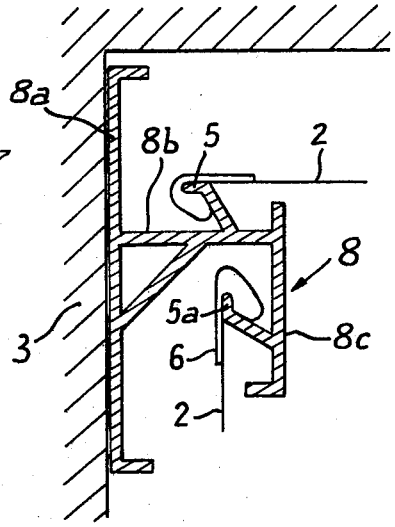
FIGS. 3, 4 and 5 are vertical cross-sections through modified forms of the rail.
Figure 2:
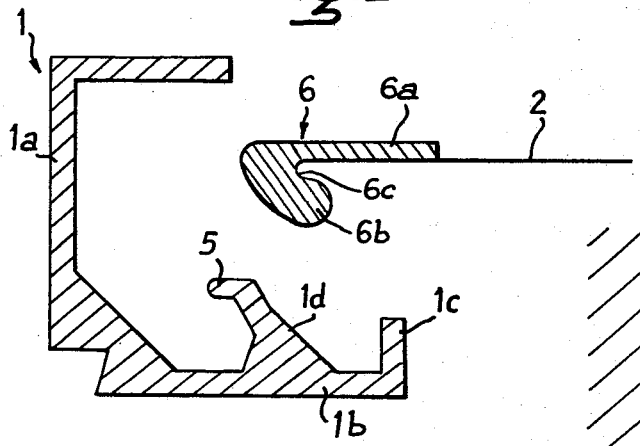
FIG. 2 is a vertical cross-section through the rail and cloth, this latter being shown disengaged from the rail.

FIG. 4 shows a rail 8 to which two cloths 2 may be hooked, namely one forming a false ceiling and the other forming a false wall. The rail 8 comprises a vertical web 8*a* fixed to the wall 3, a horizontal flange 8*b* extending from the web 8*a* and comprising an upper horizontal shoulder 5 turned towards the web 8*a* to allow a horizontal cloth 2 forming a false ceiling to be positioned, and a vertical flange 8*c* extending downwards from the end of the horizontal flange 8*b* and comprising a lower vertical shoulder 5*a* turned upwards, i.e. in the direction of the flange 8*b*, for gripping the edge 6 of a cloth 2 forming a wall lining.

Figure 5:
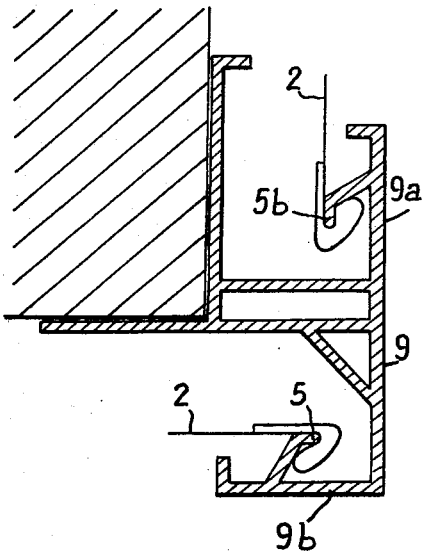

FIG. 5 shows a modified form of a rail 9 comprising a vertical flange 9*a* with an upper vertical shoulder 5*b* directed downwards for positioning a cloth 2 forming a wall lining, and a horizontal lower flange 9*b* comprising a horizontal shoulder 5 turned towards the flange 9*a* for positioning another cloth 2 forming a false ceiling.

Figure 6:
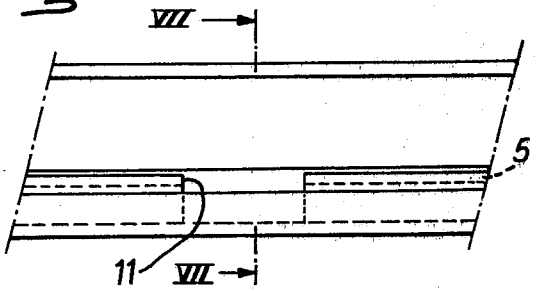
FIG. 6 is a partial elevation of the rail close to a corner of the room.
Figure 7:
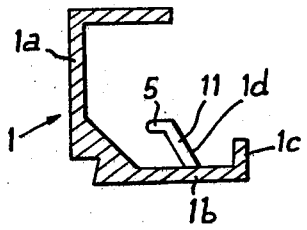
FIG. 7 is a vertical section on the line VII—VII of FIG. 6.

To assemble the false ceiling, the rail 1, 7, 8 or 9, is firstly fixed to the top of the room to form a horizontal frame. Notches 11 are then formed in the horizontal shoulders 5 and underlying ribs 1*d* (FIGS. 6, 7 and 10) at the interior corners and at an appropriate distance from the vertices of these corners. The distance between each notch 11 is of the order of 20 cam for example.

When this operation has been carried out, the edge 6 of the harpoon shape is engaged through the notch 11 in the various corners of the rail 1 by a rigid spatula or an angular blade.

Figure 8:
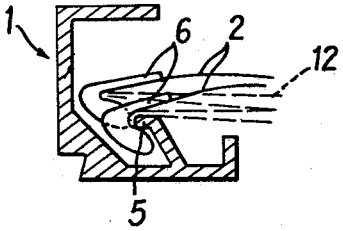
FIGS. 8 and 9 are diagrammatic vertical sections showing the operations involved in engaging the cloth with the rail and disengaging it therefrom respectively.
Figure 10:
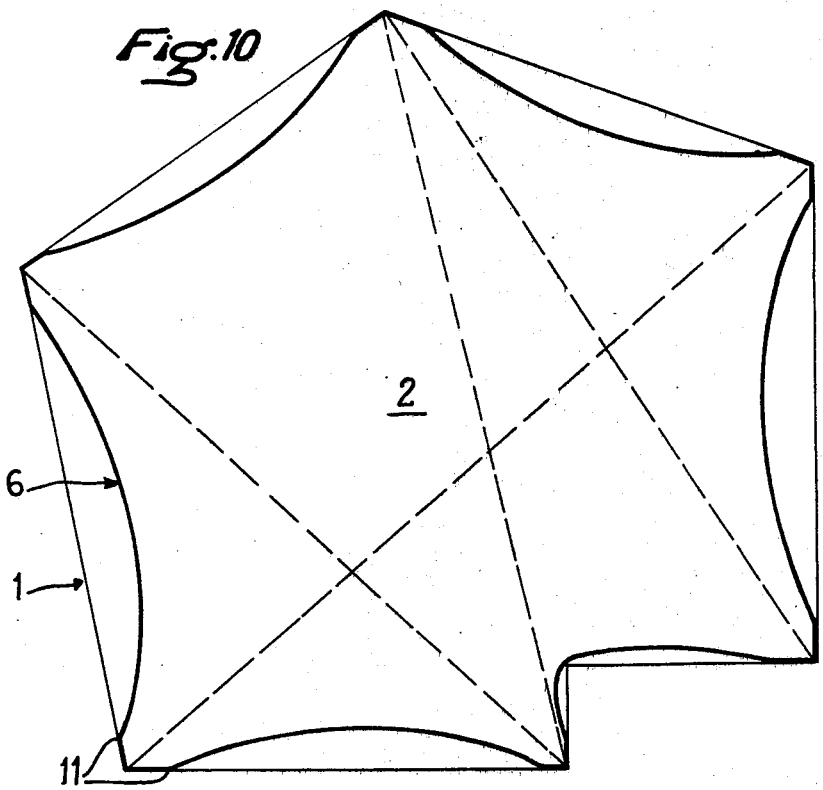
FIG. 10 is a diagrammatic plan view showing the positioning of a cloth which forms the ceiling of a room of polygonal section.

FIG. 8 illustrates diagrammatically the positioning of the harpoon edge 6 after being passed through the notch 11 by spatula 12 shown as a dashed line. When the harpoon edge 6 has been positioned on the shoulders 5 provided at the interior corners of the rail, the cloth 2 is as shown in FIG. 10. It can be seen that the border of the cloth 2 forms a curve between two notches 11 separated from the rail 1. This edge can then be engaged on the whole length of the rail shoulder 5 by a spatula or a wheel, by sliding it along the edge of the rail comprising notches at a regular distance.

Figure 9:
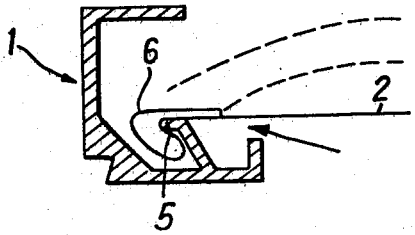

As the harpoon 6 is freely placed on the shoulder 5, its own traction balances it. As FIG. 9 clearly shows, there is no difficulty in disengaging the cloth 2. It is only necessary to push from below upwards in the direction of the arrow to disengage the resilient harpoon edge 6 from the shoulder 5, after which the sheet 2 is free.

As this disengagement may be done by hand without the use of any pointed object, there is no risk of tearing the cloth 2.

The false ceiling according to the invention has the advantage of being able to be easily positioned by non-specialised personnel. Moreover, the dimensions of the sections forming the edge 6 and rail 1 do not need to be very precise.

Figure 11:
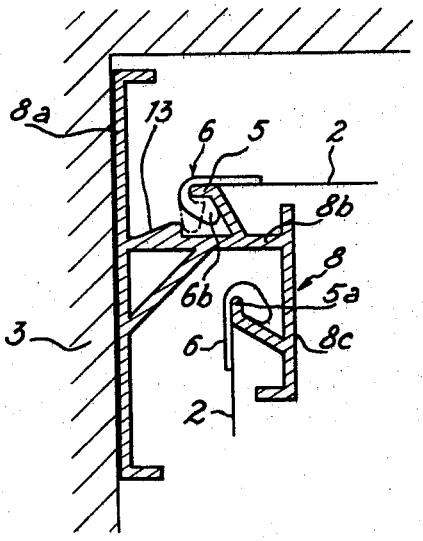
FIG. 11 illustrates a modification of a construction according to the invention.

Referring now to FIG. 11, this shows a rail 8 with a vertical flange 8*a* fixed to the wall, a horizontal flange 8*b* extending from the flange 8*a* and comprising an upper horizontal shoulder 5 turned towards the flange 8*a* to allow a horizontal cloth 2 forming a false ceiling to be positioned.

According to this modification of the invention, the horizontal flange 8*b* comprises on its upper face behind the shoulder 5, i.e. between this latter and the vertical flange 8*a*, an abutment 13 against which the end 6*b* forming the bead of the hook edge 6 strikes and is halted should this latter open under the effect of strong tension in the cloth 2.

The abutment 13 may be of any appropriate shape, and may be continuous in the form of a rib or may be interrupted. In particular it may be of the triangular shape shown in the drawing, with a vertical face against which the bead 6*b* of the hook 6 may abut, and a face inclined towards the flange 8*a*.

I claim:

1. A false ceiling or wall, comprising:

a frame adapted to be fixed to the edges of a ceiling or a wall, said frame including a pair of angularly related flanges, an abutment on one of said flanges, and a rail having a shoulder connected with one of said flanges and extending in the direction of the other and forming a free space between said abutment and itself;

a cloth sheet having a rigid edge engaged in said frame and received within said free space, said rigid edge of said sheet having a hook-shaped portion which when in place engages said shoulder;

said rail including means to facilitate the engagement of said rigid edge with said shoulder by movement of said rigid edge over said shoulder by external means;

said facilitating means including notches cut out of the shoulder in each corner of the ceiling or wall, said notches being close to the vertices of the corner to engage said rigid edge on the whole length of said rail; and, said shoulder extending in a direction opposite to that in which said sheet will exert tension and together with said abutment prevents said hook-shaped portion from being pulled around said shoulder and dislodging said rigid edge from said shoulder by the effect of strong tension in said sheet.

2. A false ceiling or wall as claimed in claim 1, wherein the edge of the sheet is harpoon-like and comprises a thin first part bonded to the sheet and extending beyond the cloth and terminating in a thicker second part in the form of a bead which, together with the first part, defines therebetween a groove open towards the sheet and in which the rail shoulder may be housed when the cloth is stretched onto the frame.

3. A false ceiling or wall as claimed in claim 2, wherein said first part of the edge is high frequency welded to the sheet.

4. A false ceiling or wall as claimed in claim 2, wherein second part of the edge is of rounded shape and has no sharp corners.

5. A false ceiling or wall as claimed in claim 2, wherein said an abutment is on said one flange behind the shoulder against which the bead will strike and be halted should this latter be pulled round by the effect of strong tension in the sheet.

6. A false ceiling or wall as claimed in claim 1, wherein the edge of the sheet is constructed of a really resilient plastics material, the cross-section of which has a shape which is constant, both before and after its positioning on the rail shoulder.

7. A false ceiling or wall as claimed in claim 1, wherein the rail is of inverted T form and is fixed by its central web to the wall or ceiling, and comprises on the two opposing flanges perpendicular to the web, respective shoulders parallel to the flanges and turned towards the central web.

8. A false ceiling and wall as claimed in claim 1, wherein the rail comprises two shoulders which are horizontally and vertically directed, respectively, the horizontal shoulder being for receiving a sheet forming a false ceiling, and the vertical shoulder being for receiving a sheet forming a false wall.

9. A false ceiling or wall as claimed in claim 1, wherein:

said facilitating means includes notches cut out of said shoulder between said corner notches; and, said external means is a spatula adapted to engage said rigid edge of said sheet and slide along said shoulder for engagement of the whole of said rigid edge with said shoulder.

10. A false ceiling or wall as claimed in claim 1, wherein:

said harpoon edge includes a thin part fixed with said sheet and a thick part connected with said thin part and having its free end extending in a reverse direction towards said sheet and forming therebetween a groove which opens towards the center of said sheet; and, said shoulder being received in said groove and bearing thereagainst.

* * * * *